US005626342A

United States Patent [19]

Foster

[11] Patent Number: 5,626,342

[45] Date of Patent: May 6, 1997

[54] FLOOR GAME FOR VELCRO-RECEPTIVE BALLS AND VELCRO BEARING DISKS

[75] Inventor: George Foster, Signal Hill, Calif.

[73] Assignee: Elliot Rudell, Torrance, Calif.

[21] Appl. No.: 574,772

[22] Filed: Dec. 19, 1995

Related U.S. Application Data

[60] Division of Ser. No. 508,485, Jul. 28, 1995, Pat. No. 5,538,253, which is a continuation-in-part of Ser. No. 276,818, Jul. 18, 1994, Pat. No. 5,452,902.

[51] Int. Cl.[6] ..... A63B 67/02

[52] U.S. Cl. ..... 273/348.4; 273/317.6; 273/DIG. 30

[58] Field of Search ..... 273/346, 317.6, 273/108.3, DIG. 30

[56] References Cited

U.S. PATENT DOCUMENTS

| | | | |
|---|---|---|---|
| 541,387 | 6/1895 | Rahmer | 273/317.6 |
| 1,527,480 | 2/1925 | Hooper | 273/317.6 |
| 2,187,524 | 1/1940 | Price | 273/344 |
| 4,244,576 | 1/1981 | Mosier et al. | 473/159 |
| 4,718,677 | 1/1988 | Barnes | 273/346 X |
| 4,735,420 | 4/1988 | Seidler | 273/346 X |
| 4,995,617 | 2/1991 | Lee | 273/346 |
| 5,195,745 | 3/1993 | Rudell et al. | 273/346 X |
| 5,452,902 | 9/1995 | Foster et al. | 273/346 |
| 5,538,253 | 7/1996 | Foster | 273/346 |

FOREIGN PATENT DOCUMENTS

| | | | |
|---|---|---|---|
| 944598 | 12/1963 | United Kingdom | 273/346 |

*Primary Examiner*—William H. Grieb

*Attorney, Agent, or Firm*—Blakely Sokoloff Taylor & Zafman

[57] ABSTRACT

A miniature golf game that utilizes hook and loop material commonly referred to as VELCRO to capture a ball rolled onto a green. The game includes a miniature green that has a simulated hole covered with VELCRO material. The VELCRO material can either be sewn into the green or attached to a disk that is placed onto the hole. The green may also have a sandtrap patch that has VELCRO material. A VELCRO covered ball is rolled onto the green with a golf club. The golf ball becomes attached to the simulated hole or patch when the ball is rolled into the simulated hole or patch areas. There is also disclosed a hook and loop baseball game that includes a miniature field which simulates a baseball diamond. The baseball game has a plurality of VELCRO covered disks located throughout the field. A player throws a VELCRO covered ball at the disks on the field. A disk is removed from the field when the ball strikes the disk. Each removed disk may represent a single, home run, out, etc. that is attributed to the player throwing the ball.

3 Claims, 2 Drawing Sheets

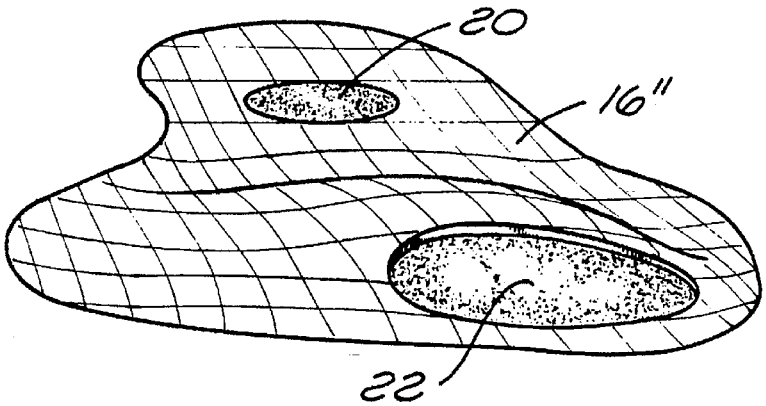
FIG. 4
FIG. 5
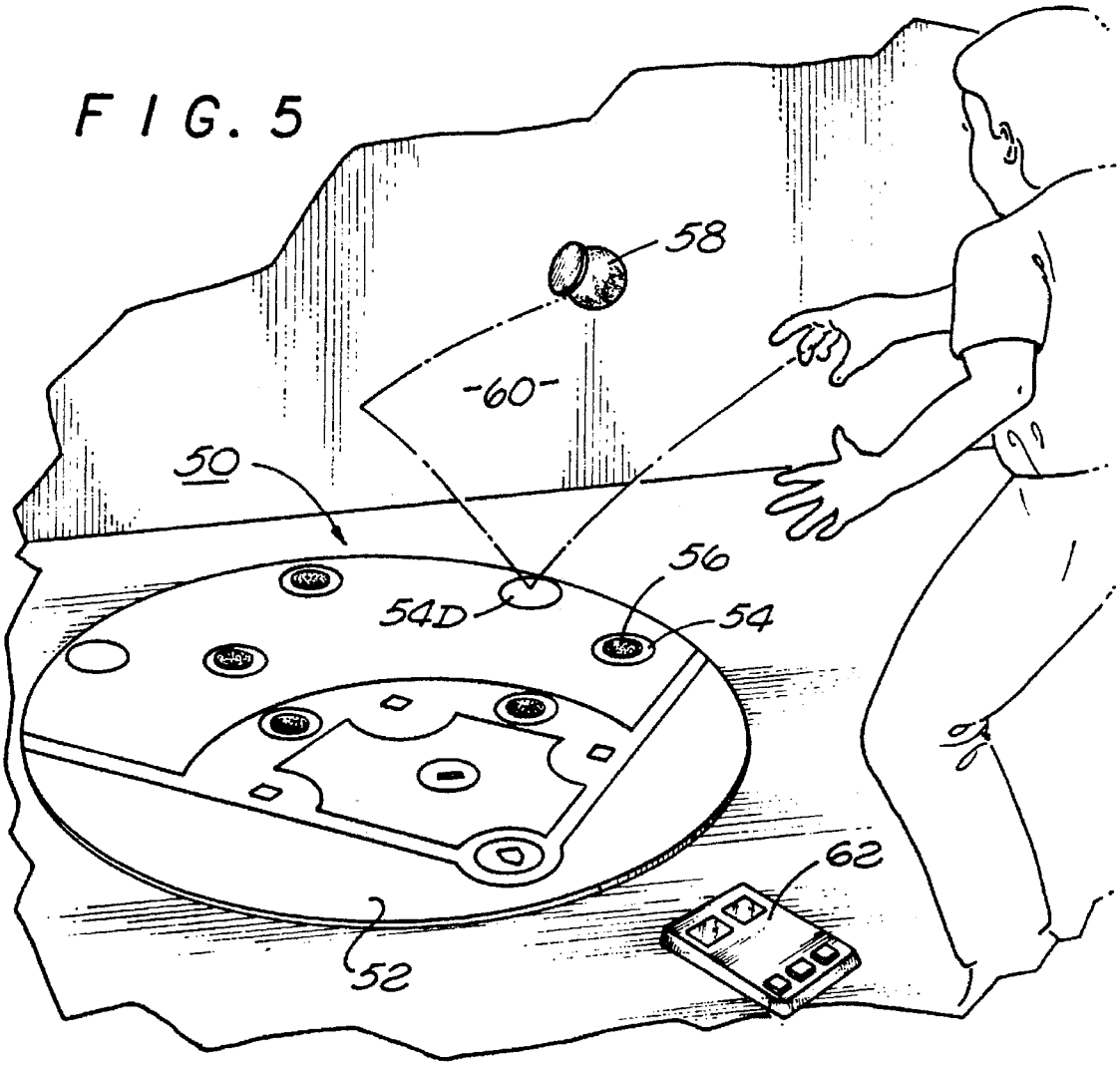

FLOOR GAME FOR VELCRO-RECEPTIVE BALLS AND VELCRO BEARING DISKS

This is a Divisional application of application Ser. No. 08/508,485, filed Jul. 28, 1995 now U.S. Pat. No. 5,538,253, which is a continuation in part of application Ser. No. 08/276,818 filed on Jul. 18, 1994, now U.S. Pat. No. 5,452,902.

BACKGROUND OF THE INVENTION

1. Field of the Invention

The present invention relates to miniature golf and baseball games that utilize hook and loop material.

2. Description of Related Art

Hook and loop material, commonly sold under the tradename VELCRO is used in a variety of different game sets. For example, Impulse Ltd. marketed a VELCRO game set under the trademark STICKY FINGERS that contained baseballs, footballs, disks and corresponding gloves which were covered with hook and loop material to assist in catching the projectiles.

U.S. Pat. No. 4,995,617 issued to Lee discloses a similar VELCRO game set which includes a disk and a corresponding glove that are covered with hook and loop material.

U.S. Pat. No. 5,195,745 issued to Rudell et al., discloses a football and glove game set which have corresponding hook and loop material that is used to grasp the football.

U.S. Pat. No. 4,718,677 issued to Barnes discloses a throw and catch game that includes VELCRO covered elbow and knee pads that are used to catch a VELCRO covered ball.

U.S. Pat. No. 4,735,420 issued to Seidler discloses a VELCRO covered paddle that is used to catch a VELCRO covered ball.

U.S. Pat. No. 4,244,576 issued to Mosier, et al. discloses a miniature golf game that includes a VELCRO covered ball that is shot at a green that is almost entirely covered with VELCRO attaching material. The VELCRO green captures and prevents the ball from rolling into the hole unless the ball has a sufficient velocity to overcome the mutual attraction of the VELCRO. Although effective in preventing an errant roll of the ball, the Mosier game does not accurately simulate putting a golf ball onto a golf green.

It would be desirable to provide a VELCRO based golf game that captured a ball rolled into a hole and which penalized a player for hitting into an area away from the hole. It would also be desirable to provide a VELCRO based baseball game.

SUMMARY OF THE INVENTION

The present invention is a miniature golf game that utilizes hook and loop material commonly referred to as VELCRO to capture a ball rolled onto a green. The game includes a miniature green that has a simulated hole covered with VELCRO material. The VELCRO material can either be sewn into the green or attached to a disk that is placed onto the hole. The green may also have a sandtrap patch that has VELCRO material. A VELCRO covered ball is rolled onto the green with a golf club. The golf ball becomes attached to the hole or patch when the ball is rolled into the simulated hole or patch areas.

There is also disclosed a hook and loop baseball game that includes a miniature field which simulates a baseball diamond. The baseball game has a plurality of VELCRO covered disks located throughout the field. A player throws a VELCRO covered ball at the disks on the field. A disk is removed from the field when the ball strikes the disk. Each removed disk may represent a single, home run, out, etc. that is attributed to the player throwing the ball.

BRIEF DESCRIPTION OF THE DRAWINGS

The objects and advantages of the present invention will become more readily apparent to those ordinarily skilled in the art after reviewing the following detailed description and accompanying drawings, wherein:

FIG. 4 is a perspective view showing an alternate embodiment of the green;

FIG. 5 is a perspective view showing a baseball game set of the present invention.

DETAILED DESCRIPTION OF THE INVENTION

Figure 1:
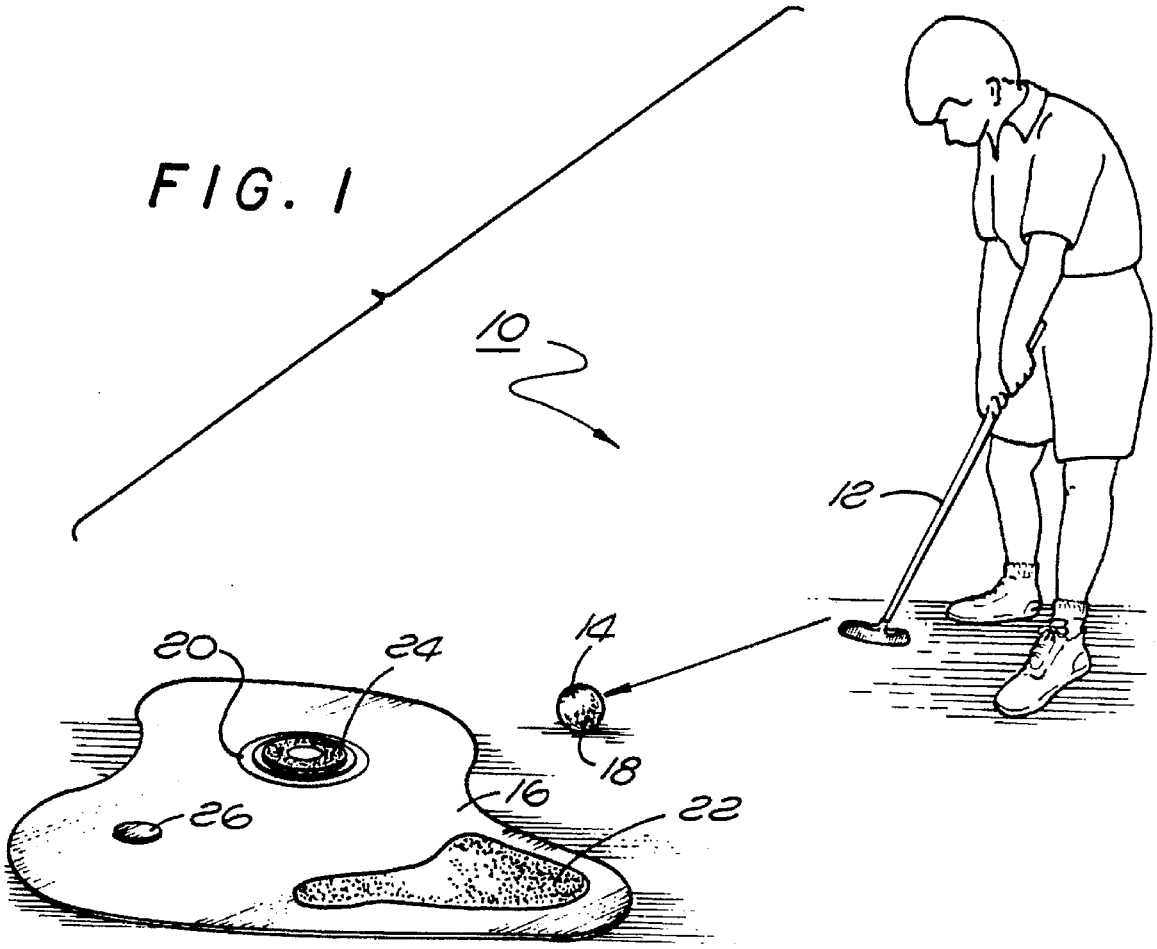
FIG. 1 is a perspective view of a golf game set of the present invention.

Referring to the drawings more particularly by reference numbers, FIG. 1 shows a golf game set 10 of the present invention. The game set 10 is used to play a game of miniature golf. The game set 10 includes a golf club 12 that is used to strike and roll a ball 14 onto a green 16. The golf club 12 may be constructed from a relatively inexpensive plastic mold material that can be operated by children. The ball 14 is covered by attachment material 18. The attachment material 18 is preferably hook and loop material commonly sold under the trademark VELCRO. The ball 14 may have an outer nap material that will readily adhere to corresponding VELCRO hook material.

Figure 2:
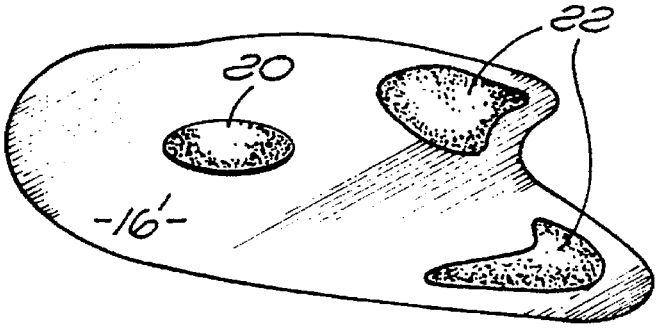
FIG. 2 is a perspective view showing an alternate embodiment of the golf green.

The green 16 may have a circle to designate a simulated "golf hole" 20 and a "sandtrap" 22. The sandtrap 22 may include a patch of attachment material that becomes attached to the attachment material of the ball 14 when the ball 14 is rolled into the sandtrap 20. A disk 24 may be placed onto the hole 20. The disk 24 may be covered with attachment material so that the ball 14 becomes attached to the disk 24 and the simulated hole 20 when the ball 14 rolls onto the disk 24. FIG. 2 shows an alternate embodiment of a green 16' which has attachment material sewn onto the simulated hole 20. The game set 10 may also have a ball marker 26 that can be placed onto the green when the players are rotating turns. The disk 24 may also be used as a marker.

To play the game, a player strikes the ball 14 with the golf club 12 to roll the ball 14 toward the simulated hole 20. If the ball 14 rolls onto the simulated hole 20, the attachment material captures and maintains the position of the ball 14, signifying that the player "sank" the shot. The player can repeatedly strike the ball 14, until the ball 14 is captured within the simulated hole 20. If the player rolls the ball 14 into the sandtrap 22 the attachment material of the trap 22 will capture and hold the ball 14. The player can pull the ball 14 out of the sandtrap 22 and incur a penalty stroke, or try to strike the ball 14 to overcome the force of the VELCRO and roll the ball 14 toward the simulated hole 20. The players can keep score of the golf game by removing and replacing the disk when the ball becomes attached to the disk on the green. The players may alternate shots and collect disks. A player may win the game by collecting a predetermined number of disks.

Figure 3:
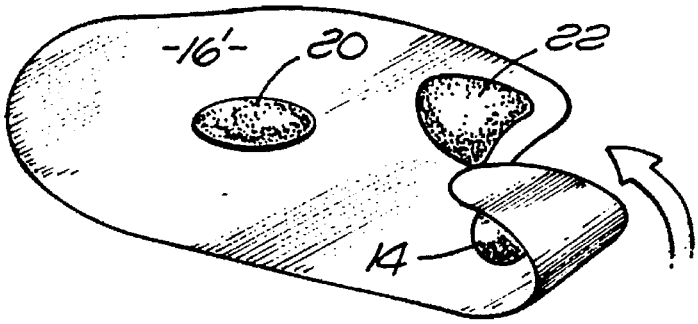
FIG. 3 is a perspective view showing a portion of the green rolled onto a ball captured by hook and loop material.

As shown in FIG. 3, green 16 can be constructed from a flexible material that will fold onto the ball 14 when the ball 14 is captured by a sandtrap 22. The folding of the green 12 increases the difficulty of removing the ball 14 from the trap 22. The green 16 may be constructed from a felt material that can be folded and stored when not in use.

FIG. 4 shows an alternate embodiment of a green 16" constructed to have a three dimensional contour shape. The green 16" may be constructed from a molded plastic material which provides ridges and rolls that further increase the difficulty of playing the game. The simulated hole 20 and sandtrap 22 can be inset relative to the surface of the green 16".

FIG. 5 shows a baseball game set 50 of the present invention. The game set 50 includes a field 52 that has indicia which simulates a baseball diamond. The field 52 may be constructed from a felt or other mat material. The diamond has a plurality of disk locations 54. A disk 56 is placed into each location 54. The disks 56 are covered with attachment material such as hook and loop material (VELCRO). The game set 50 also includes a ball 58 that can be thrown at the disks 56. The ball 58 is covered with attachment material that becomes attached to the attachment material of the disks 56 when the ball 58 comes into contact with the disks 56. The attachment material of the ball is preferably hook and loop VELCRO material.

To play a game, a player can throw a ball 58 at one of the disks 56. If the ball 58 strikes the disk 56 the attachment material causes the disk 56 to become attached to the ball 58. The ball 58 can be bounced off of a wall 60 back to the player. Each disk location 54 may correspond to an event within a baseball ball game such as a single, a home run, or an out. By way of example, the disk location 54D may represent a double. If a player captures, with the ball 58, the disk 56 in disk location 54D the player is accredited with a double. Consecutive doubles would produce a "run" and so forth and so on. The game set 50 may include a counter 62 to track the score of the game. The field 52 may have disk locations 54 that are designated "out". While a first player attempts to attach their ball 58 to a disk 56 on a "hit" disk location a second player may attempt to throw their ball at an "out" disk. The first player is "out" when the second player is successful in capturing an "out" disk with a ball.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art. For example, although VELCRO has been shown and described, the attachment material may be attractive magnets or a sticky adhesive. In the preferred embodiment, the disks contain hook material and the balls contain attaching loop material, although it is to be understood that the disks may contain loop material and the ball may have attaching hook material.

What is claimed is:

1. A method of playing a simulated game of baseball, comprising the steps of:

a) placing a plurality of disks onto disk locations of a simulated baseball field, each disk having an attachment material;

b) throwing a ball at said disks, said ball having attachment material that becomes attached to said attachment material of said disks when said ball comes into contact with said disks; and, c) repeating step (b) until all of said disks are removed from said field.

2. The method as recited in claim 1, wherein a hit is attributed to a player who causes a disk to become attached to said ball.

3. The method as recited in claim 2, wherein said ball is bounced off of a wall.

* * * * *